United States Patent [19]

George

[11] 4,130,303

[45] Dec. 19, 1978

[54] REINFORCED PIPE CROSS FITTING

[75] Inventor: Henry H. George, Louisville, Ky.

[73] Assignee: Chemetron Corporation, Chicago, Ill.

[21] Appl. No.: 800,325

[22] Filed: May 25, 1977

[51] Int. Cl.[2] ..... F16L 39/00

[52] U.S. Cl. ..... 285/137 R; 285/150; 285/286; 138/115; 138/39; 138/172; 138/178

[58] Field of Search ..... 285/150, 286, 156, 131, 285/132, 137 R; 138/111, 115, 116, 117; 403/173, 174; 248/DIG. 6, 27.1, 57; 137/625.44

[56] References Cited

U.S. PATENT DOCUMENTS

| | | | |
|---|---|---|---|
| 2,284,937 | 6/1942 | Wood | 285/132 |
| 3,336,056 | 8/1967 | Cassel et al. | 285/137 R |
| 3,468,560 | 9/1969 | Cassel | 285/137 R X |
| 3,504,707 | 4/1970 | Cassel et al. | 138/116 |
| 3,531,844 | 10/1970 | Cassel et al. | 285/137 R X |
| 3,989,396 | 11/1976 | Matsumoto et al. | 403/173 X |

FOREIGN PATENT DOCUMENTS

| | | | |
|---|---|---|---|
| 124897 | 8/1947 | Australia | 285/150 |
| 728005 | 4/1955 | United Kingdom | 285/114 |

*Primary Examiner*—Werner H. Schroeder
*Attorney, Agent, or Firm*—Vincent G. Gioia

[57] ABSTRACT

A pipe cross fitting for interconnecting tubular structural members of an offshore platform of the type used by the oil industry. The cross fitting is reinforced by the addition of an internal structural element that extends across the central open portion of the fitting and into all of the branches of the fitting to resist the tension and compression forces applied to the fitting during use.

8 Claims, 5 Drawing Figures

REINFORCED PIPE CROSS FITTING

BACKGROUND OF THE INVENTION

1. Field of the Invention

This invention pertains to pipe cross fittings.

2. Description of the Prior Art

A conventional pipe cross fitting of the type having four branches arranged in pairs, with each pair being located on an axis and the axes being coplanar and at right angles to each other, (which may be called an X joint) while commonly used in hydraulic applications, has not been used too successfully as a joint in an off-shore platform which is normally constructed of primary tubular members which are braced by other tubular members that are in turn connected together by joints such as K, T, Y, and X joints. The cross joints, since subjected in the structure to tension forces on one opposed pair of branches or legs and compression on the other, tend to collapse at low loads as the tension portions elongate, with reduction in diameter, and the compression portions accentuate this tendency. The joint since it has a large open central portion has little structure available to resist same. Attempts have been made in the past to increase and stiffen, externally or internally, the wall thickness in this area, but without substantial success.

SUMMARY OF THE INVENTION

Applicant has designed a cross joint or fitting that is intended to alleviate the disadvantages of the prior art. Specifically, Applicant has provided a reinforcement element for the central open portion of a conventional (and previously described) fitting that also extends into each of the branches or legs to distribute the loads thereover and thus also to strengthen the entire fitting against compression or tension forces. In one embodiment, the reinforcement element is a plate located in the fitting coplanar with the fitting axes and which has an outer peripheral edge substantially approaching the inner surfaces of the fitting, including the fitting branches. To insert the plate into a conventional cross fitting, requires the forming of the fitting in halves, or the parting of same in halves and the later joining of the halves after the insertion of the plate. Since, the plate is essentially fitted into the fitting, uniform support thereof is provided. The plate may be extended substantially the length of each branch and may also be attached by welding to each branch of the fitting depending upon the application. Clearly the completed fitting will, because of the reinforcement plate, be considerably more resistant to failure from the aforementioned loads than the conventional cross fitting described, and also any fabricated cross fittings due to the further possibility of failures of the numerous welds needed.

Applicant, in another embodiment, has designed a reinforced cross fitting that is more economical to produce since no forming of the fitting or parting of same in halves along with the later joining process is required. In this embodiment, a first plate is located in a conventional cross fitting and extends through the center portion and into each branch of a pair of branches and generally parallel to their axis. A second plate is located in the fitting parallel to the other axis and extends into each branch of a pair branches related to the latter axis. The two plates are then rigidly attached to each other. It is to be noted that this resulting integral element is not fitted to the fitting as in the first embodiment and hence does not give as great a support thereto. Preferably, each plate substantially spans its related branches. Each plate may also be rigidly attached to its related branches. Alternately, in a third embodiment, the second plate may be constructed as two separate plates, with a plate extending into one branch and the other into the other of the same axis. In this instance, each plate is rigidly attached to the first (full) plate, and possibly to its respective branch. In this third embodiment, as in the second, the resulting fitting has also a greater resistance to loads of compression and tension upon the fitting proper than an unreinforced fitting but less than the first embodiment.

It is, therefore, an object of this invention to provide a new and improved reinforced pipe cross fitting.

Another object of this invention is to provide a reinforced pipe cross fitting that can be manufactured at low cost.

DESCRIPTION OF THE PREFERRED EMBODIMENT

Figure 1:
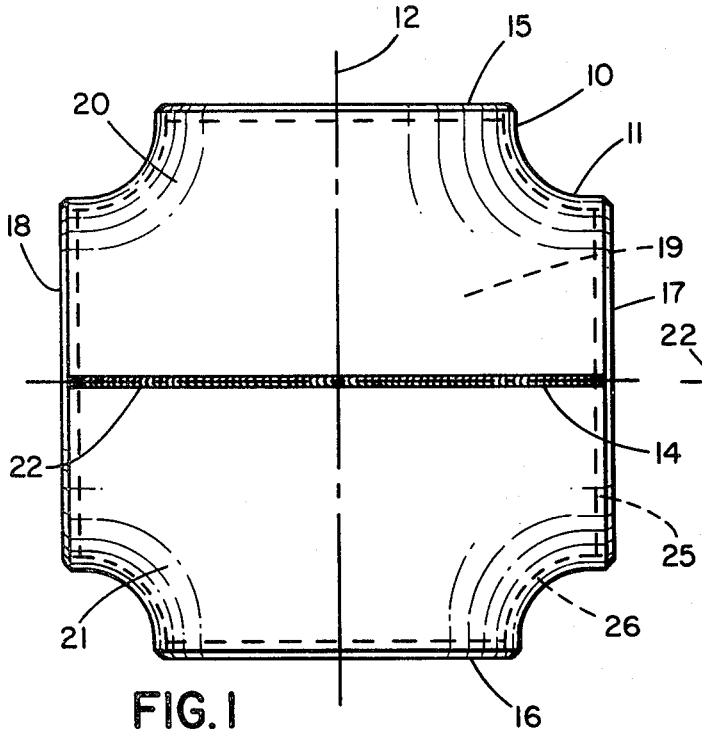
FIG. 1 is a front view of the cross fitting of this invention.
Figure 2:
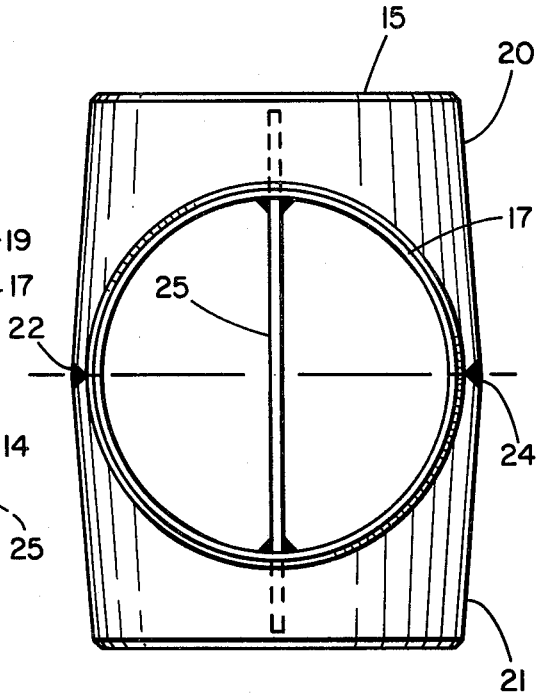
FIG. 2 is a side view of the fitting of FIG. 1.

Referring to FIGS. 1 and 2, 10 indicates the reinforced pipe cross fitting of this invention. Fitting 10 includes conventional, preferably steel, pipe cross fitting 11 having axis 12 and axis 14 which are normal to each other and coplanar. Axis 12 has branches or legs 15 and 16 (with cylindrical openings therethrough) located thereon and axis 14 has similar branches 17 and 18. The branch openings intersect to form a central open portion 19 of the fitting 11. All branch ends are suitably beveled for butt welding to similarly sized tubular members of an off-shore platform.

Fitting 11 may be formed in halves or parted into halves 20, 21 generally along axis 14 (See FIG. 2) for the insertion of the later to be described reinforcing element. After insertion of the element, the halves are preferably butt welded together at welds 22 and 24.

Reinforcing element 25 is located in fitting 11 and is generally coplanar with axis 12 and axis 14. Preferably element 25 has an outer peripheral edge 26 that closely approaches the inner surfaces of fitting 11 including that of all of the branches. Preferably also the edge of element 25 may be welded on both sides thereof to the adjacent surfaces of the interior of each branch of fitting 11 as shown in FIG. 2 and longitudinally thereof as may be convenient.

Figure 3:
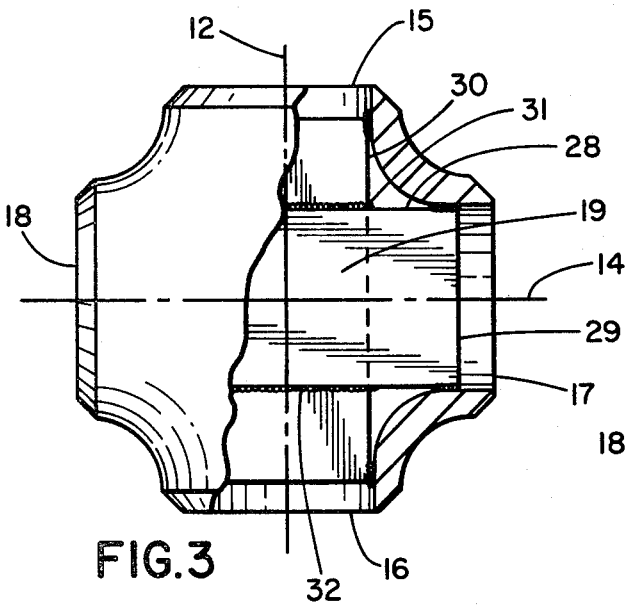
FIG. 3 is a side view (partially in section) of another embodiment of the cross fitting of this invention.
Figure 4:
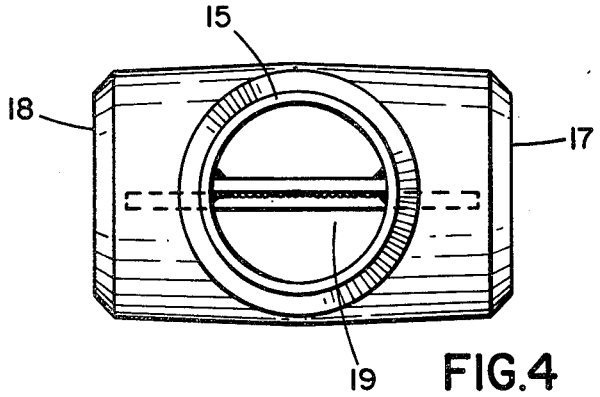
FIG. 4 is a top view of the fitting of FIG. 3.

Referring to FIGS. 3 and 4, another embodiment of the reinforced pipe cross fitting of this invention is disclosed. The fitting of FIG. 3 does not require the forming or parting of same in halves for the insertion of the reinforcing element and the later attachment of the halves, and hence is less expensive. Instead, a conventional, preferably steel, pipe cross fitting is utilized without change and the reinforcing element is applied thereto. Inasmuch as when re-assembled the fittings are essentially the same, the features of the fitting of FIG. 3 are similarly numbered as those of FIG. 1 except for the reinforcing element denoted 28. Element 28 is composed of plate 29 which extends parallel to axis 12 and axis 14 and into the branches 17 and 18 related to axis 14, and also plate 30. Plate 30 also is parallel to the axis 12 and axis 14 and extends into the branches 15 and 16 which are related to axis 12. As shown, plates 29 and 30 are welded together, after installation into fitting 11, at welds 31 and 32 with access thereto from the branches 15 and 16 respectively. Depending upon the application, the now rigid element 28 may also be welded to the interior of each branch substantially as shown in FIGS. 3 and 4. Unlike the embodiment of FIG. 1, the embodiment of FIG. 3 is not closely fitted to the entire inner surfaces of fitting 11 including the branches thereof. However, substantial support is still provided to the open portion 19 of the fitting 11 and all of the branches.

Figure 5:
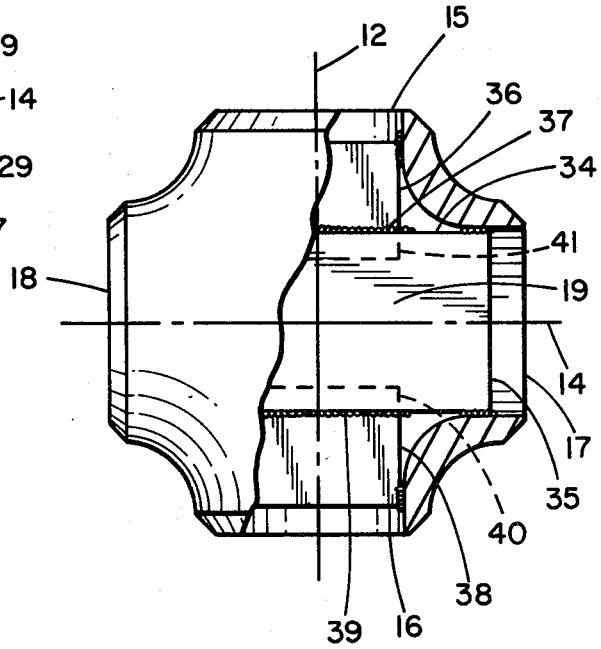
FIG. 5 is a side view of still another embodiment of the fitting of this invention.

Referring to FIG. 5, this reinforced fitting differs from that of FIG. 3 in that two full plates that extend through aligned branches are not used. Instead, a full plate and two partial plates are used. This differing reinforcing element is denominated 34. Element 34 has full plate 35 (which corresponds to plate 29 of the second embodiment) and extends parallel to axis 12 and axis 14 and into branches 17 and 18 related to axis 14. Partial plate 36 is also parallel to the noted axes and extends into branch 15 related to axis 12 from its connection with full plate 35 at weld 37. Partial plate 38 is also parallel to the noted axes and extends into branch 16 of related axis 12 from its connection to full plate 35 at weld 39. If needed, further welds could be applied to 40 and 41 from open branch 14 and likewise from branch 18. As in FIG. 3 and FIG. 4 (which would be a similar plan view for FIG. 5) reinforcing element 34, when constructed in fitting 11, can then be welded to the fitting branches as shown in FIGS. 5 and 4 if desired. The embodiment of FIG. 5 also does not have the fitted construction of FIG. 1, but does provide strength for the open portion of the fitting and all of the branches as in FIG. 3 and does so in an economical manner.

Having this described the invention, it will be apparent to those skilled in the art that various modifications can be made without departing from the spirit of the invention or the scope of the appended claims.

I claim:

1. A reinforced pipe cross fitting of the type having four branches arranged in pairs, each pair being located on an axis, and the axes being coplanar and being oriented at right angles to each other, wherein an improvement comprises a rigid plate-like reinforcing element located in said fitting, said element being generally coplanar with the axes and extending substantially to the ends of each branch and reinforcing each branch of the fitting.

2. The fitting of claim 1 in which said element substantially spans each branch where same extends therein.

3. The fitting of claim 2 in which said element is rigidly attached to each branch where same extends therein.

4. The fitting of claim 1 in which said element that is coplanar with said axes has an outer peripheral edge substantially approaching the inner surfaces of said fitting including all of said branches.

5. The fitting of claim 1 in which said element comprises a plate extending parallel to an axis and into the pair of branches on said axis and a second plate extending parallel to another axis and into the pair of branches on said another axis, said plates being rigidly joined to each other.

6. The fitting of claim 5 in which said plates substantially span the branches where they extend therein and are rigidly attached to each branch.

7. The fitting of claim 1 in which said element comprises a plate extending parallel to an axis and into the pair of branches on said axis, and a second plate extending parallel to another axis and extending into one of the pair of branches of said another axis, said second plate being rigidly attached to said plate, and a third plate extending parallel to said another axis and extending into the second of the pair of branches of said another axis, said third plate being rigidly attached to said plate.

8. The fitting of claim 7 in which said a plate substantially spans its respective branches and is rigidly attached thereto and said third and fourth plates substantially span their respective branches and are rigidly attached thereto.

* * * * *